US005443238A

United States Patent [19]

Mitchell

[11] Patent Number: 5,443,238

[45] Date of Patent: Aug. 22, 1995

[54] FRAMED PICTURE HANGER SYSTEM

[76] Inventor: Lawrence Mitchell, 1073 Martingale Dr., Bartlett, Ill. 60103

[21] Appl. No.: 193,938

[22] Filed: Feb. 9, 1994

[51] Int. Cl.[6] ..... A47E 1/16

[52] U.S. Cl. ..... 248/498; 40/152.1

[58] Field of Search ..... 248/497, 498, 489, 475.1, 248/547, 488, 490, 494, 301; 40/152.1, 158.1

[56] References Cited

U.S. PATENT DOCUMENTS

| | | | |
|---|---|---|---|
| 3,226,065 | 12/1965 | Smith | 248/547 |
| 3,982,719 | 9/1976 | Kilborne | 248/489 |
| 4,117,613 | 10/1978 | Hosker | 40/152.1 |
| 5,075,991 | 12/1991 | Wenkman et al. | 40/152.1 |
| 5,133,526 | 7/1992 | Olmsted | 248/495 |
| 5,328,140 | 7/1994 | Wone | 248/498 X |
| 5,342,014 | 8/1994 | Wilson | 248/497 X |

*Primary Examiner*—Ramon O. Ramirez

*Attorney, Agent, or Firm*—Leydig, Voit & Mayer, Ltd.

[57] ABSTRACT

A picture hanging system using a flexible sheet material device in a generally T-shaped form having an opening adjacent the outer end of the center leg and the head includes spaced legs at opposite ends extending parallel to the leg and the leg is threadable through die cut slits in a backing member that is attachable to a picture frame or the like. The hanger device which is preferably cut out from mylar sheet material provides a strong and sturdy hanger which together with the threadable attachment to the slit sheet backing member will support and hold considerable framed picture weight and mounting with conventional wall fastener devices.

4 Claims, 1 Drawing Sheet

FIG. 1
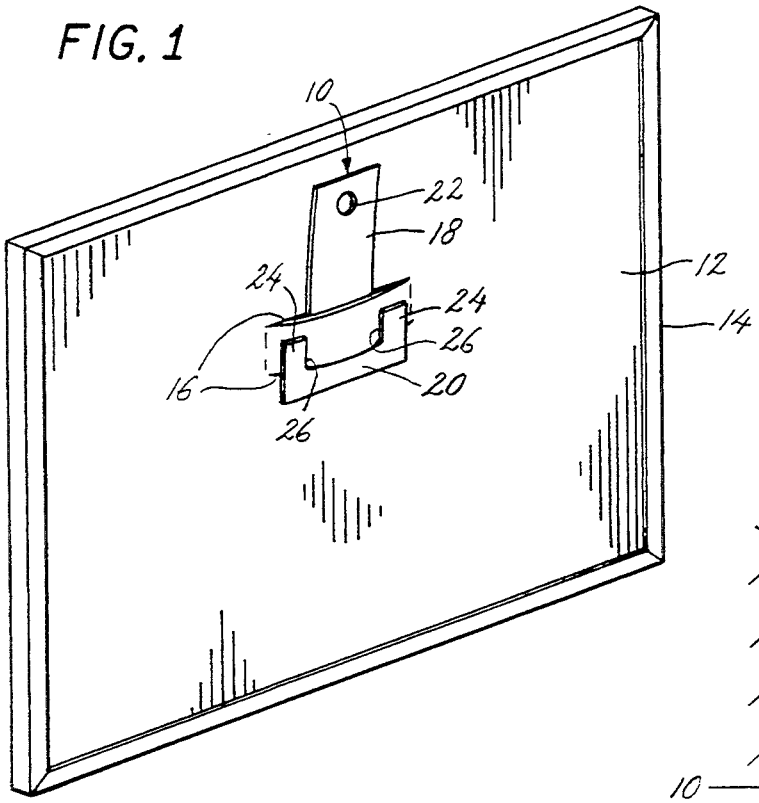
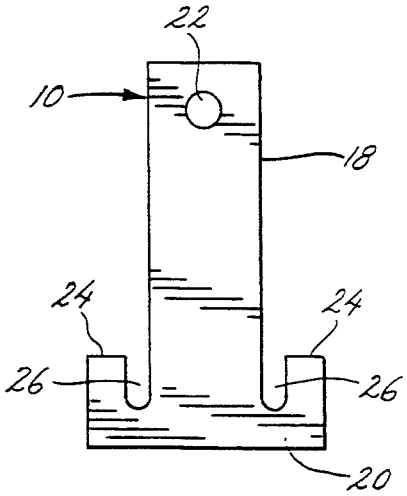
FIG. 2
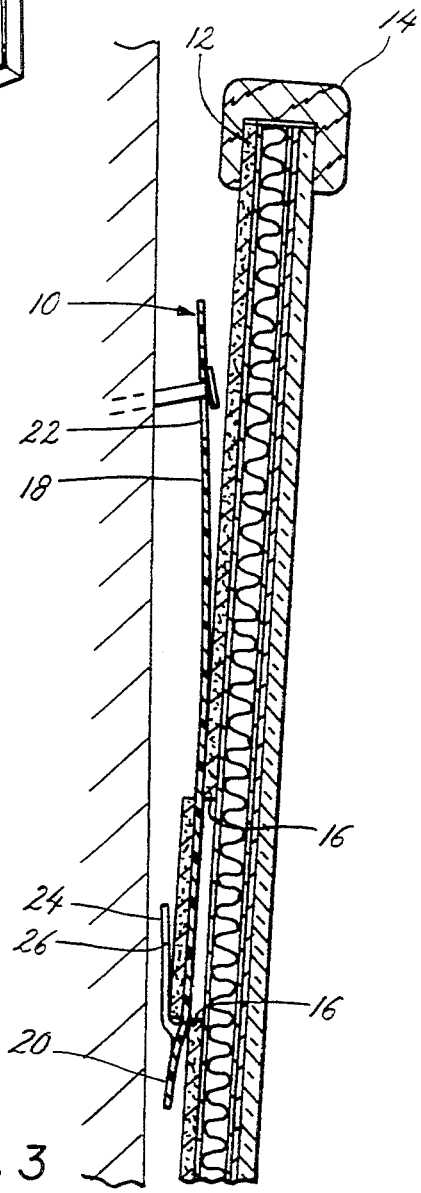
FIG. 3

FRAMED PICTURE HANGER SYSTEM

BACKGROUND OF THE INVENTION

The present invention relates generally to picture hanger devices, and more particularly, to an easily applied, relatively low cost system for hanging framed pictures or the like to walls.

DESCRIPTION OF THE PRIOR ART

A host of different types of devices have been long used in conjunction with the back of a framed picture or the like that provides a hanger means to be used with a nail or conventional picture hook affixed to a wall. Such devices have ranged from eye hooks used with wire, to specialty brackets, hooks or eyelets, to even die cut openings in a backing affixed to the picture frame. While such devices may have provided fulfillment of the necessary requirements for securely hanging a picture, each suffers some kind of drawback, such as the complexity or difficulty in mounting the device, costliness of the device or being limited in its providing, for example, sufficient ease in installation and in hanging of the picture to the wall fastener.

OBJECTS AND SUMMARY OF THE INVENTION

Accordingly, it is a primary object of this invention to provide an improved hanger device which is relatively low in cost and can be easily applied and used for hanging of framed pictures or the like to walls. As another object of the present invention to provide a simply attachable hanger device for framed pictures which can be easily used in connection with typical wall fasteners such as nails, picture J-hooks or the like that facilitates the ease of hanging and adjusting the picture on the wall.

SUMMARY OF THE INVENTION

In general, the present invention contemplates a flexible sheet material device in a generally T-shaped form having an opening adjacent the outer end of the center leg and the head includes spaced legs at opposite ends extending parallel to the leg and the leg is threadable through die cut slits in a backing member that is attachable to a picture frame or the like. A hanger device which is preferably cut out from mylar sheet material provides a strong and sturdy hanger which together with the threadable attachment to the slit sheet backing member will support and hold considerable framed picture weight and mounting with conventional wall fastener devices.

These and other features and advantages of the invention will be more readily apparent upon reading the following description of the preferred exemplified embodiment of the invention upon reference to the accompanying drawings therein.

BRIEF DESCRIPTION OF THE DRAWINGS

FIG. 1 is a rear perspective view of an exemplary framed picture incorporating the hanger system of the invention;

FIG. 2 is a plan view of the hanger device of the present invention in its flat condition; and FIG. 3 is a sectional plan view of the backing member with he hanger device in place.

DETAILED DESCRIPTION OF THE INVENTION

Turning to the drawings, there is shown in FIG. 1, the exemplary hanger device generally indicated at 10, on a backing member 12 as applied to a picture frame 14. The picture frame 14 may be of the four-sided type so that includes channels adapted to receive from front to back a transparent plate-like member such as glass or plastic, a picture or art work itself or one that has been matted and one or more backing members that serve to hold the picture or the like flat against the transparent plate like member as well as possibly filling in the frame channels. More often, picture frames have an opening along one edge of the framed members to permit the sliding insertion of the transparent member, picture and backing until they engage a channel at the upper edge member which functions as a stop.

It will be understood as discussion proceeds that the present framed picture hanging system, may be used with various different types of frames and term "picture" as used in here is intended to include any of the types of items which may be framed such as, for example, photographs, documents, certificates, prints, or art works.

In accordance with the present invention, as shown in FIG. 1, a backing member 12 is provided, preferably made from a semi-rigid cardboard stock and there is provided in the backing member a pair of spaced apart slits 16, preferably located centrally from the side edges and above the top to bottom center. Picture frames are provided in a wide number of dimensions and even shapes, with some typical sizes being, for example, 5'×7', 8'×10', 11'×14', 16'×20', etc. In keeping with the present invention, the semi-rigid backing member 12 may be provided in any one or a number of such sizes or even shapes such as oval or round and the spaced slits provided in the backing member as may be necessary to hang the picture in an upright position. It will further be appreciated that with certain shapes or sizes of backing members, more than one pair of slits may be provided to receive hanger devices 10 for either vertical or horizontal position hanging or even to provide multiple hangers for larger pieces.

In accordance with one of the important features of the present invention, the hanger device 10 is formed from flexible sheet-like material, preferably mylar, and is in a generally T-shape with a main leg 18 and cross head 20. The main leg includes an opening 22 adjacent its outer end and the cross head has fingers 24 at its outer ends with troughs 26 that include rounded over ends. The main leg of the hanger device may be threaded through the slits until the fingers extend over the portion of the backing member between the slits and the bottom rounded edges of the troughs engage the lower slit end thus forming a stop. The holding arrangement between the cross head and fingers and the bottom slit are extremely strong such that a great deal of weight can be supported with this arrangement. The main leg being flexible provides a hanger end with its opening 22 that can be easily manipulated to affix the framed picture to a wall fastener such a nail or J type picture hook. The backing member may be affixed to the picture frame in any of a variety of ways such as that described above where it just slips into channels or it can be secured to the picture frame with any of a variety of well known fastener devices.

I claim:

1. A hanger device for use with a picture frame, said picture frame having a top edge, a bottom edge, and a pair of side edges, said hanger device comprising:

a plate like backing member adapted to be secured to said frame, said backing member including upper and lower spaced apart slits, said slits being positioned centrally with respect to said side edges and above the center between said top and bottom edges; and a flat, flexible, and generally T-shaped hanger device including a main leg having an outer end and a cross head having a pair of outer ends, with said main leg being threadable through said slits of said backing member until said cross head functions as a stop with respect to said lower slit, and said main leg of said hanger device having an opening adjacent its outer end adapted to be received by a wall fastener device.

2. A framed picture hanger device as claimed in claim 1 wherein said backing member is made of cardboard stock.

3. A framed picture hanger device as claimed in claim 1 wherein said hanger device is made of mylar material.

4. A framed picture hanger device as claimed in claim 1 wherein said hanger device cross head includes fingers adjacent its outer ends extending substantially parallel to said main leg and having troughs therebetween.

* * * * *